US011666165B2

(12) United States Patent
Watson

(10) Patent No.: US 11,666,165 B2
(45) Date of Patent: Jun. 6, 2023

(54) HANGETIC

(71) Applicant: Simon John Watson, Stoke-On-Trent (GB)

(72) Inventor: Simon John Watson, Stoke-On-Trent (GB)

( * ) Notice: Subject to any disclaimer, the term of this patent is extended or adjusted under 35 U.S.C. 154(b) by 0 days.

(21) Appl. No.: 17/248,316

(22) Filed: Jan. 20, 2021

(65) Prior Publication Data

US 2023/0092112 A1 Mar. 23, 2023

(51) Int. Cl.
*A47G 25/32* (2006.01)

(52) U.S. Cl.
CPC ..... *A47G 25/32* (2013.01)

(58) Field of Classification Search
CPC ..... A47G 25/16; A47G 25/28; A47G 25/32; A47G 25/40; A47G 25/4046; A47G 25/4061
USPC ..... 223/85, 88, 89, 90, DIG. 4; 248/100, 248/211, 213, 215, 225.21, 227.1, 234, 248/301, 303, 304, 322, 339, 617, 690, 248/691, 692
See application file for complete search history.

(56) References Cited

U.S. PATENT DOCUMENTS 2,392,257 A * 1/1946 O'Neal ..... A47G 25/32 223/88
2,549,730 A * 4/1951 Wassarman ..... A47G 25/32 223/85
2,671,938 A * 3/1954 Roberts ..... A47G 25/32 24/716
2,795,025 A * 6/1957 Wexler ..... A47G 25/32 24/23 R
2,864,147 A * 12/1958 Solow ..... A47G 25/32 D6/318
3,048,311 A * 8/1962 Nenenfeldt ..... A47G 25/325 24/373
3,703,978 A * 11/1972 Sammartino ..... A47G 25/40 223/89
4,517,709 A * 5/1985 Arentsen ..... A47G 25/32 24/716
5,083,690 A * 1/1992 Winskas ..... E05B 69/006 D6/323
7,172,102 B2 * 2/2007 Lewien ..... A47G 25/4023 223/89
9,468,326 B2 * 10/2016 Yip ..... A47G 25/50

FOREIGN PATENT DOCUMENTS

CN 201316112 Y * 9/2009
CN 201861376 U * 6/2011
CN 202365557 U * 8/2012
CN 202477299 U * 10/2012
CN 203074168 U * 7/2013
CN 204015873 U * 12/2014
CN 209391630 U * 9/2019

* cited by examiner

*Primary Examiner* — Joshua E Rodden

(57) ABSTRACT

A clothes hanger for disabled or height restricted people with a hook which flexes or moves at the tip when the hanger is pulled downward to enable clearance of the rail pole. This movement is aided by a pivot pin and a spring mechanism; as is a collapsing horizontal bar section for leg wear derived of two equal sections with magnetic closure holding mechanism.

14 Claims, 9 Drawing Sheets

HANGETIC

FIELD OF THE INVENTION

The present invention relates to clothes hangers for hanging and storing clothes on a clothes rail pole or on a clothes rail pole/bracket within an enclosure wardrobe, to be used by disabled people or people of restricted height.

BACKGROUND

The use of clothes hangers is widely known and they are provided in many forms including versions made of wire, plastic and others of a wire and wood combination.

A person simply unhooks the hanger hook from the rail and removes the clothing or item from it, then returns the hanger via the hook back to the rail or bracket.

Brackets may also be provided on which to hang clothes, to the sides or interiors of wardrobes, for example.

A disabled person in a wheelchair who cannot stand or has difficulty standing, is often unable to reach up sufficiently to unhook the hanger hook from the rail pole, because the rail pole may be set at the height for use by an able-bodied person.

Therefore, a person of restricted height may also require similar help to remove hangers. The solid metal or plastic hooks curve further prevents the disabled person from being able to fully unhook the hanger, as it is curved around to the other side of the rail pole and thus cannot be lifted clear enough by them to remove it. Therefore, various patents have been filed to help with this situation and examples can be cited:

This is shown in U.S. Pat. No. 4,582,233 (BRICKHOUSE) discloses a wire clothes hanger is provided with a U-shaped handle portion extending downwardly from the hanger to enable use of the hanger in a conventional closet by handicapped persons confined to a wheelchair.

Patent EP1090571 (REGUITTI) discloses an invention which concerns a wardrobe clothes hanger for articles of clothing, consisting of a hook for hanging in the upper part and a shoulder part with a cross-bar. The clothes hanger may be made from any material, in a single piece or in various parts, and is furnished with a rigid or folding prolongation (14), pointing downwards and acting as a handle.

Patent JP2006068026 (YOSHIKAWA) discloses a locker highly which is usable for a person using a wheelchair or a stick and to provide a highly usable hanger for use in the locker. SOLUTION: A locker body 2, in its front face lower part, is equipped with an opening part 24 for inserting the toe part 23 of the wheel chair 22 and the opening part 24 is provided with a shoe mount shelf 25 for mounting shoes 27 slidably in the depth direction. The interior of the locker body 2 is provided with a hanger rail 16 and has hangers 30 hung thereon.

The hanger 30 is provided with a hanger body 31 for hanging clothes 11, a hook 32 and a handle 33 having one end side slidably connected to the hanger body 31. The user can easily draw out the hanger 30 and the clothes 11 to the front side by grasping and pulling a grip 36 of the handle 33.

U.S. Pat. No. 924,763 (GRANT) discloses a wooden clothes hanger with an advanced handle portion extending downwardly from the hanger area to enable use of the hanger, in a conventional closet by handicapped persons confined to a wheelchair. The disclosure also shows additional hanging points for clothing or accessories thereto.

The prior art therefore shows that there is a need for a more effective way of enabling persons in a wheelchair or with restricted height, to access clothing on hangers by being able to remove the hangers when required by way of adapted features to be disclosed herein. The present invention aims to provide an improved clothes hanger therefore.

SUMMARY OF THE INVENTION

According to the present invention there is provided a clothes hanger with adapted parts to make it usable from a wheelchair or from a restricted height.

The hanger itself is mainly of the known type which is constricted height.

The hanger itself is mainly of the known type which is constructed of a metal or flat hook protruding from a wooden or plastic shoulder frame with a horizontal bar section to the ends of the shoulder frame, for hanging leg wear or trousers.

In another embodiment, the clothes hanger may also be construed of plastic entirely. This would still enable all moving parts to perform while providing a version which can be produced from a single material type.

The hook is fixed into the top centre of the hanger, on the said shoulder frame, onto which the garment is placed. In this embodiment the hook is flat, but the last portion toward the tip of the hook is adapted.

The end of the hook may have a tip area which is able to lift due to it being a separate part, which is pivoted. The pivot is achieved via a through pin fitting which is either passing from the outside to the outside opposing surface or it may be set within the width of the hook, in a channel. To enable the tip area to operate as required within this disclosure, a spring mechanism is also applied. This provides the ability for the tip area of the hook to first move and turn and then 'snap' back to its original position; as the spring will always return to its relaxed form.

As the disabled or height restricted person removes the hanger from the rail pole, as shown in FIG. 2, the tip area is forced to turn upwards on its pivot due to the person having to pull the end of the hanger downward, due to their height limitation.

This movement of the pivot tip area of the hook thus enables the hook to have clearance to be removed from the pole, as the tip is no longer 'hooked' around the pole.

This action enables the person to pull the hanger from the rail pole and access the clothing. The reverse action of returning the clothes hanger to the pole is performed and the tip area is 'snapped' back onto the pole by turning as it is pushed against it, allowing the hanger to be returned to the rail pole.

In a further embodiment the tip area may be a single spring section which is seated and fixed directly into the end of the hook, as shown in FIG. 3 and in more close detail in FIG. 9.

The spring would therefore also allow for the tip area of the hook to flex on removal of the hanger and the return of the hanger to the pole, as aforementioned. This would benefit from being applied to a metal hook type.

To aid the removal of leg wear from the hanger, as the hanger is still in place on the pole, a collapsing horizontal bar is provided, as shown in FIG. 1.

The bar is derived of two equal lengths of suitably shaped bar which are each pivoted toward to end which is inside the ends of the shoulder sections as shown more closely in FIG. 7. The pivot is a through pin which is affixed to the inner side of the shoulder sections within a channel.

A spring mechanism is also provided at each end, to provide a 'snap' return when used. To the opposing ends of this are magnetic tips. As shown in the accompanying Figures. The legwear, such as trousers or jeans, are hung over the two bars when they are horizontally set, with the magnetic tips and spring mechanisms holding them together.

As the disabled or height restricted person pulls the leg wear downward, due to their restricted height access, the two pivoted bars are pulled with the leg wear and open, enabling the leg wear to be removed. As shown in FIG. 5.

The moment the leg wear is cleared of the two opened bar sections, they 'snap' back to their original horizontal position due to the spring mechanism and the two suitably facing magnets thereto.

In this respect, before explaining at least one embodiment of the invention in detail, it is to be understood that the invention is not limited in its application to the details of construction and to the arrangements of the components set forth in the following description or illustrated in the drawings.

The invention incapable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention.

It is important, therefore, that the claims be regarded as including such equivalent constructions insofar as they do not depart from the spirit and scope of the present invention.

Further, the purpose of the foregoing abstract is to enable the Patent Office and the public generally, and especially the scientists, engineers and practitioners in the art who are not familiar with patent or legal terms or phraseology, to determine quickly from a cursory inspection the nature and essence of the technical disclosure of the application.

The abstract is neither intended to define the invention of the application, which is measured by the claims, nor is it intended to be limiting as to the scope of the invention in any way.

It is therefore an object of the present invention to provide a new and improved clothes hanger which has all the advantages of the prior art clothes hangers and none of the disadvantages.

It is another object of the present invention to provide a new clothes hanger which may be easily and efficiently manufactured and marketed. It is a further object of the present invention to provide a new and improved clothes hanger which is of durable and reliable construction.

An even further object of the present invention is to provide a new and improved clothes hanger which is susceptible of a low cost of manufacture with regard to both materials and labour, and which accordingly is then susceptible of low prices of sale to the consuming public, thereby making such a product available to the buying public.

Still yet another object of the present invention is to provide a new and improved clothes hanger which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and detailed descriptive matter in which there is illustrated preferred embodiments of the invention.

DETAILED DESCRIPTION OF FIGURES

Figure 1:
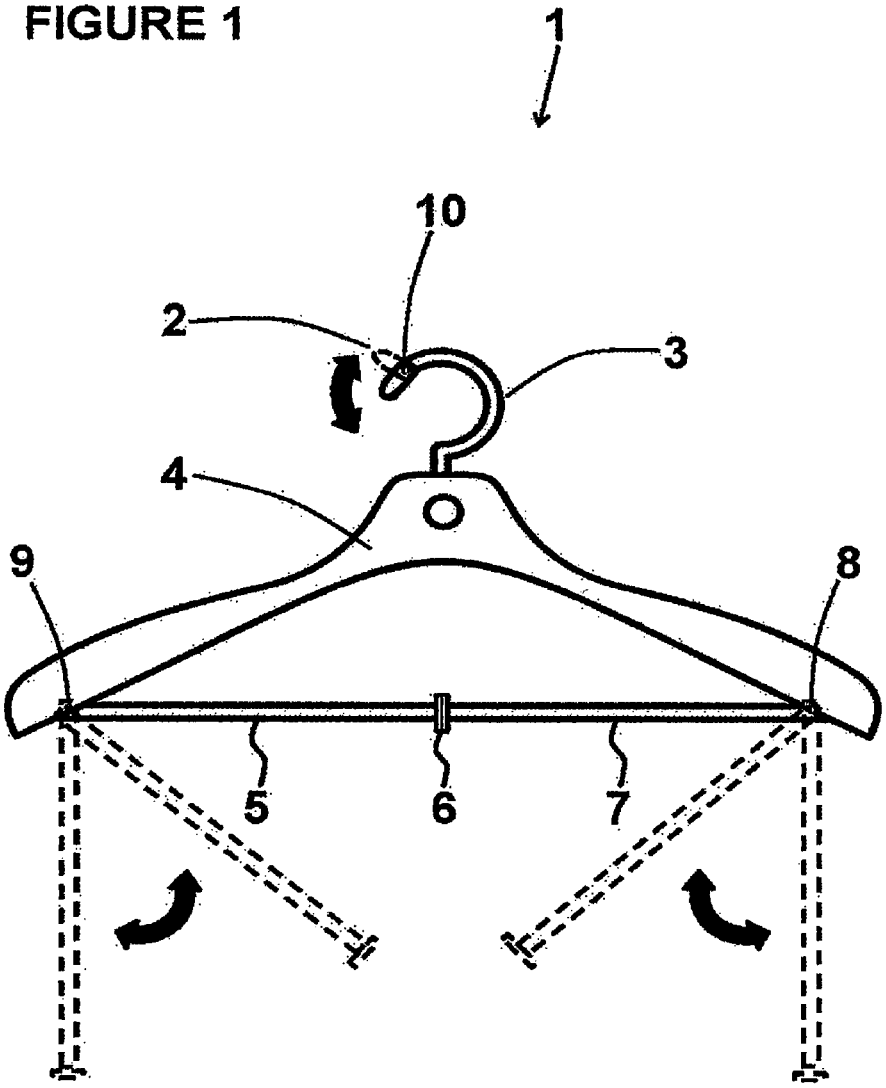
FIG. 1 shows a side view of the clothes hanger with moving parts indicated.

A typical embodiment of the clothes hanger is shown in FIG. 1. It comprises the clothes hanger 1, which has a hook 3 which is curved with an end portion of the curve being completed by a movable hook tip area 2 which has a pivot pin 10.

The hook 3 is presented vertically from the shoulder frame 4 and may be rotated vertically within its mount into the shoulder. To the ends of each shoulder is a horizontal bar section, derived from two equally sized sections 5 and 7 which are movably held in place by pivot pins 8 and 9 as shown.

To each end of the sections 5 and 7 are magnetic tips 6 which connect together when 5 and 7 are horizontal, as shown.

Figure 2:
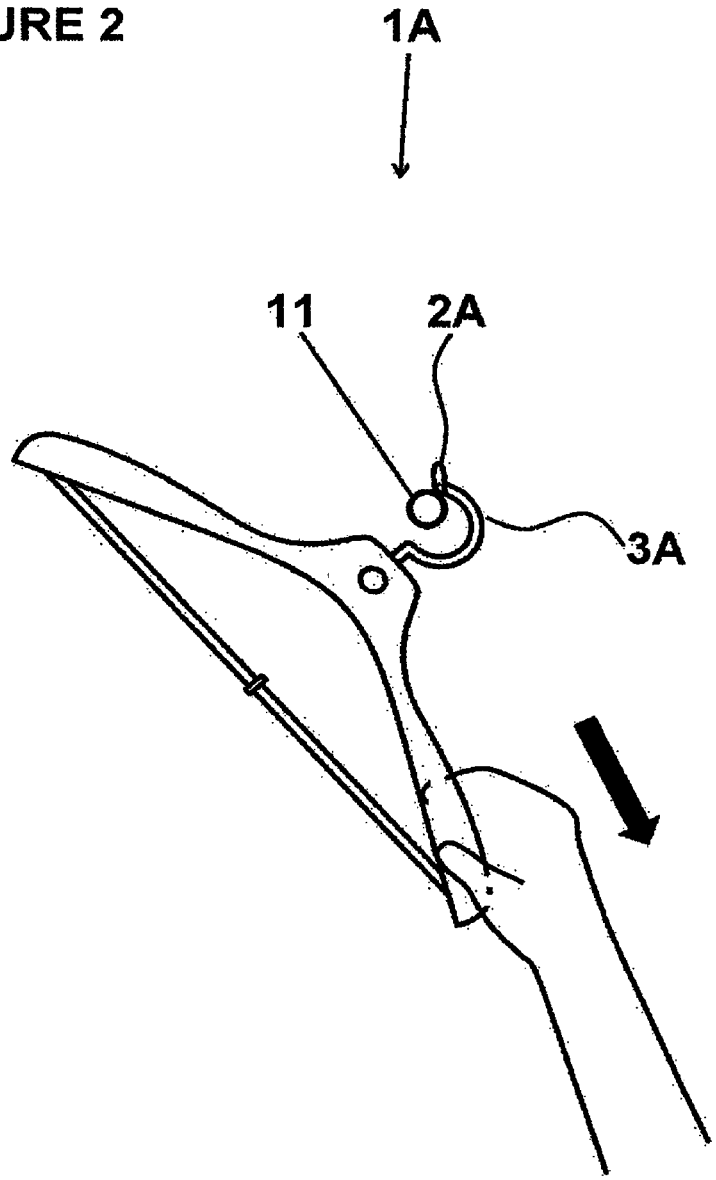
FIG. 2 shows a side view of the clothes hanger being pulled from its pole.

FIG. 2 shows the clothes hanger 1A being removed from the rail pole 11, this is enabled due to hook tip area 2A of hook 3A rotating upward on the pivot as aforementioned.

Figure 3:
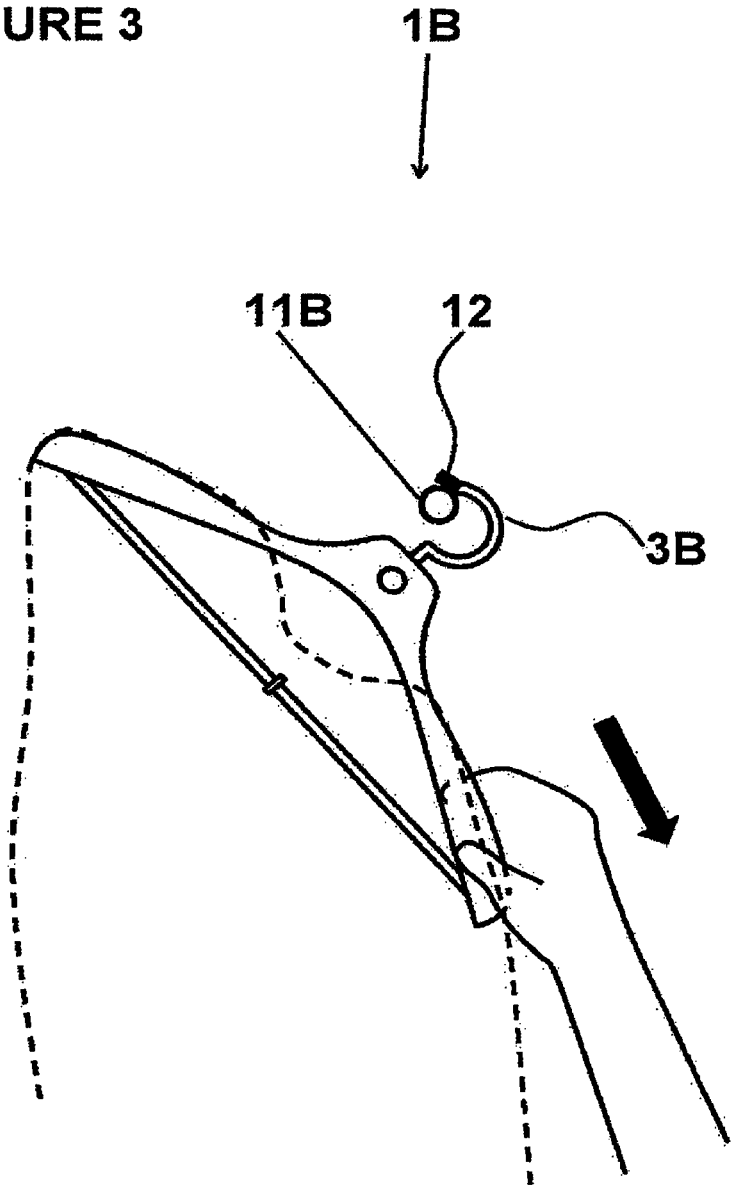
FIG. 3 shows a side view of the clothes hanger being pulled from the pole with alternative spring tip area.

A second embodiment of the clothes hanger 1B is shown in FIG. 3, wherein, the hook tip area 12 is a spring 12 which flexes on removal of the hanger 1B, also shown being removed from the rail pole 11B, enabling removal of said clothes hanger 1B.

To the lower part of the hanger 1C are sections 5C and 7C which collapse as shown when leg wear 13 is pulled downward, as aforementioned; with pivot pins 8C and 9C providing stable movement. This action also disconnects the two halves of the magnetic tips 6C.

Figure 4:
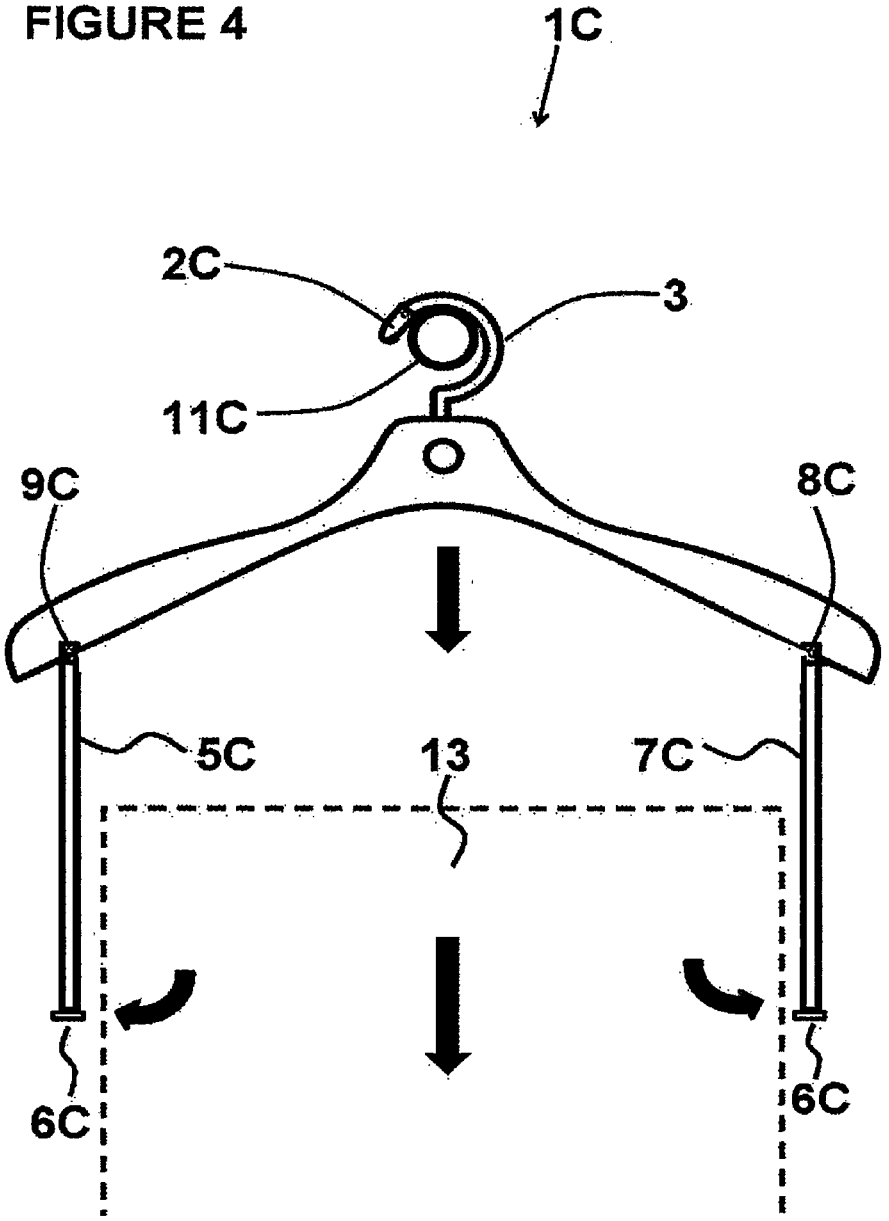
FIG. 4 shows a side view of the clothes hanger with horizontal bar sections collapsed.
Figure 5:
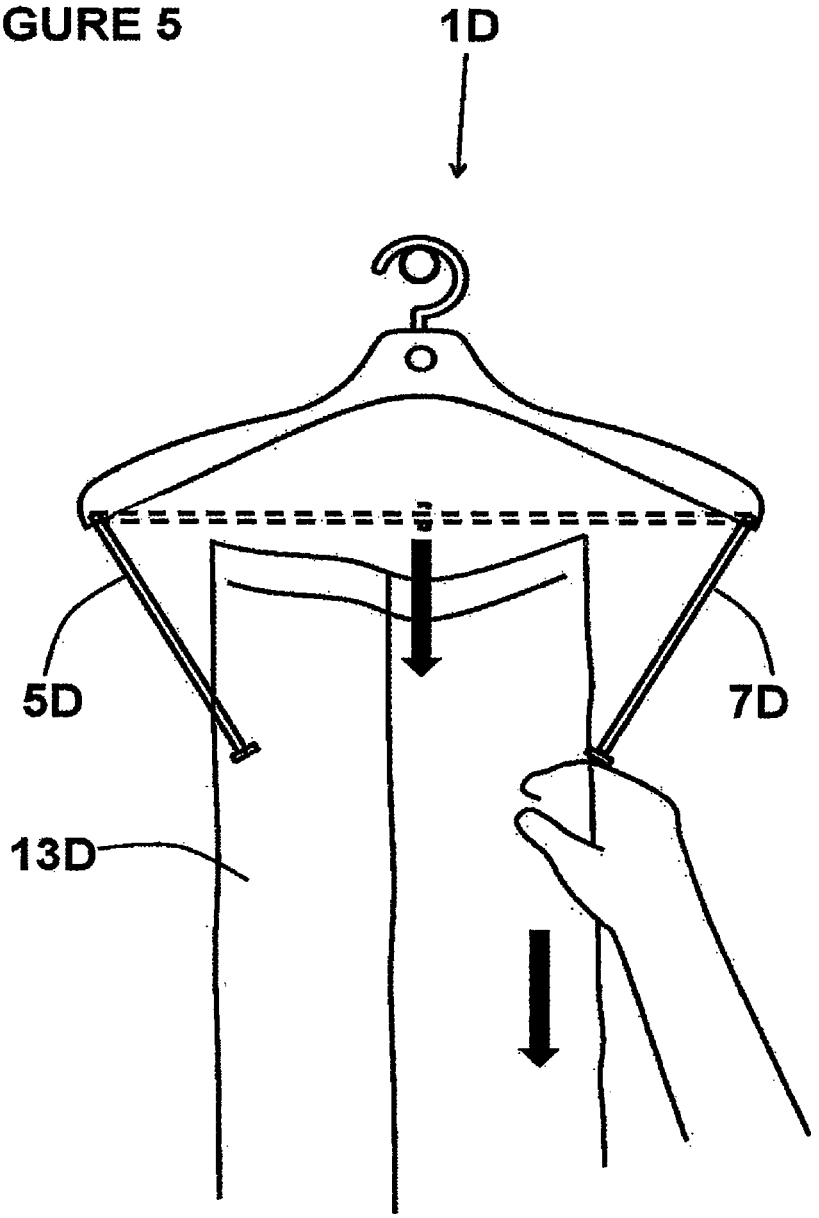
FIG. 5 shows a side view of the clothes hanger with leg wear being removed and horizontal bar indicated in place and collapsed.

The hook 3 and the hook tip area 2C are closed at this point, and hung onto the rail pole 11C, as shown in FIG. 4. FIG. 5 shows the clothes hanger 1D with the leg wear 13D being removed by the person; with sections 5D and 7D collapsing therefore.

The shoulder frame 4E houses a spring mechanism comprising of a spring 14 which is fixed to the pivot pin 9E on the shoulder frame 4E and to a fixture pin 15 on the section 5E of the horizontal bar (as shown as only half of the clothes hanger).

Figure 6:
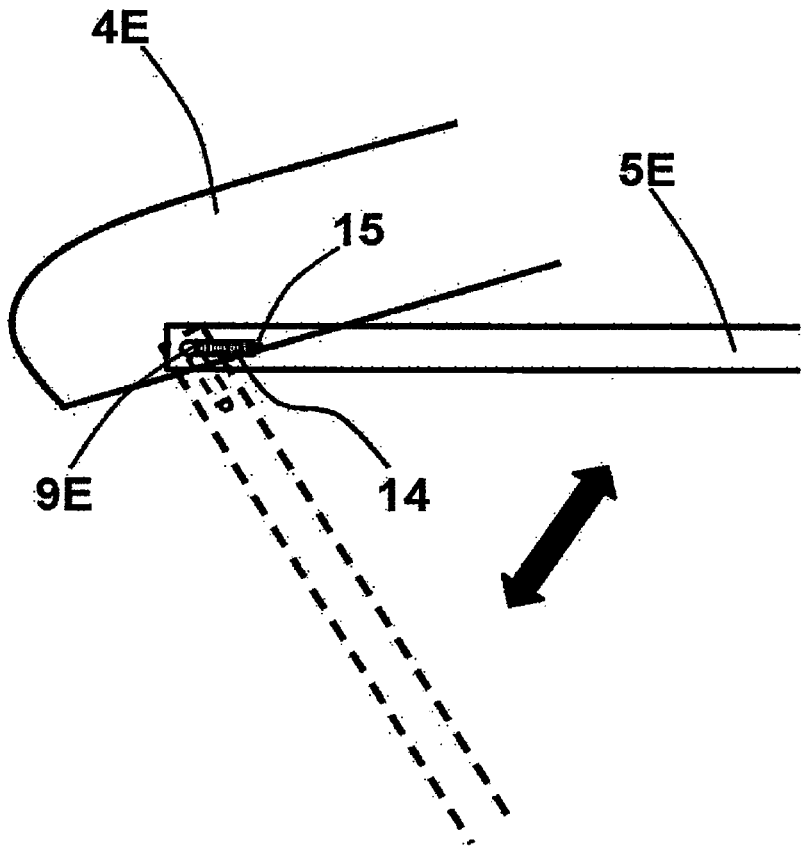
FIG. 6 shows a close-up view of the spring mechanism for the horizontal bar sections.

Thus, the section 5E can be pulled downward, extending the spring 14, as indicated by the broken lines and returns to its horizontal position afterwards due to the spring 14 returning to its relaxed form. As shown in FIG. 6.

Figure 7:
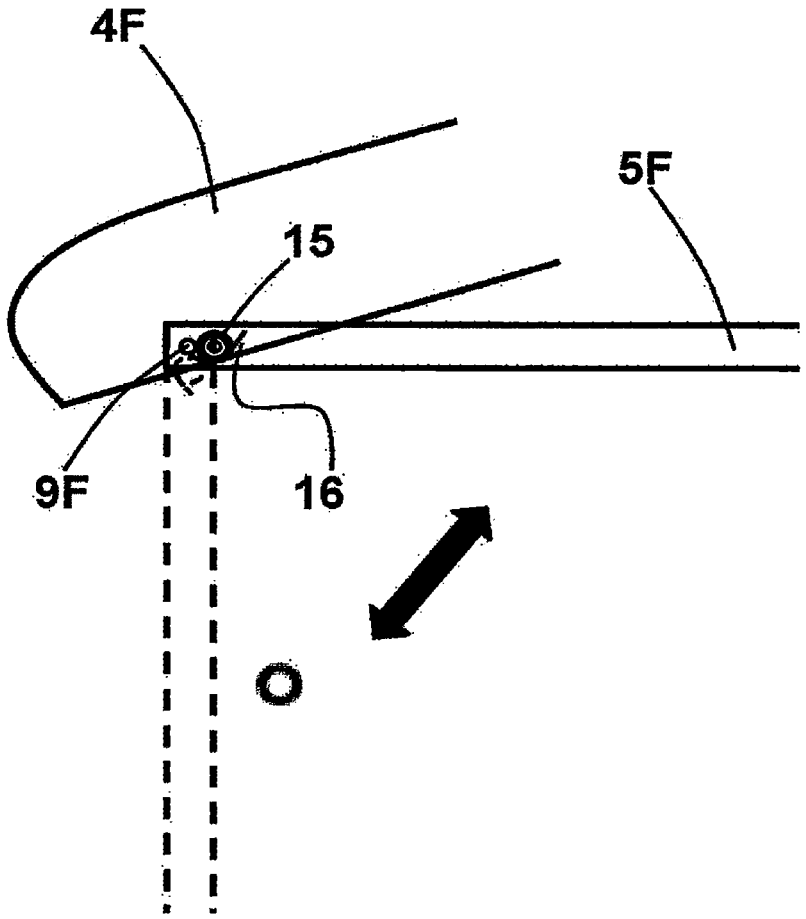
FIG. 7 shows a close-up view of the spring mechanism for the horizontal bar sections, with coil spring alternative.

FIG. 7 shows a second option for the action described in FIG. 6, using a coiled spring 15 which is aided by spring retainers 16 and uses the pivot pin 9F as a spring retainer. These are set within the end of the shoulder frame 4F and provide a 'snap' return of sections 5F (as shown as only half of the clothes hanger).

Figure 8:
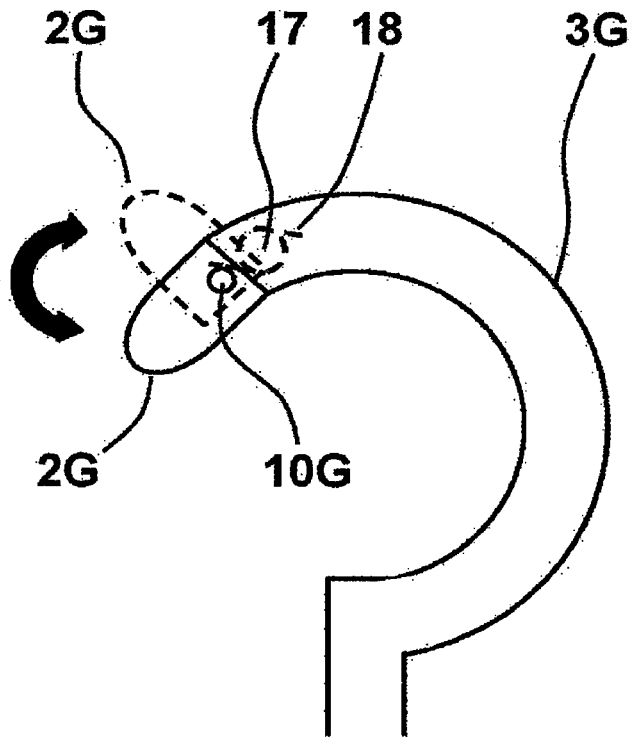
FIG. 8 shows a close up of the moving spring tip area of the clothes hanger hook.

The hook 3G is shown as a close view in FIG. 8 which shows the coiled spring 17 with its retainer 18. The hook tip area 2G pivots on the pivot pin 10G and turns on this axis, tensioned against the coiled spring 17.

Figure 9:
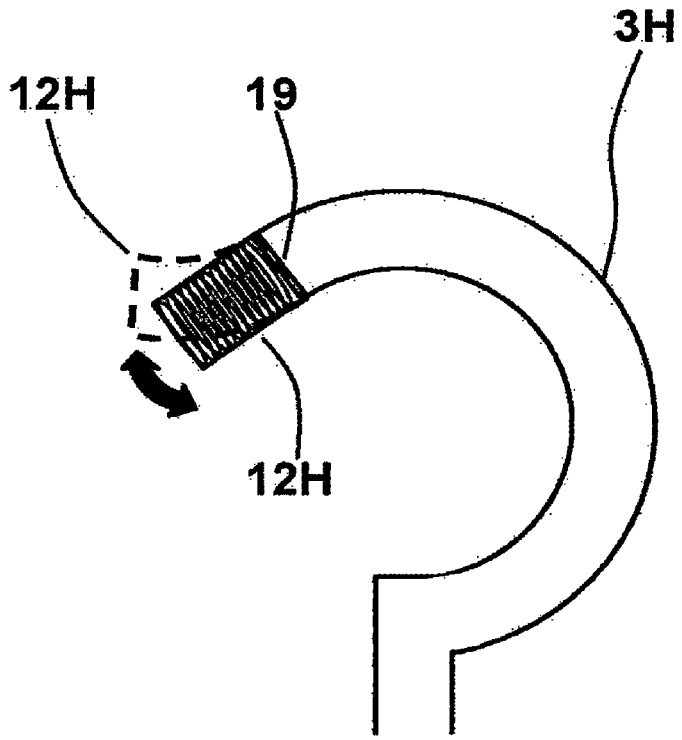
FIG. 9 shows a close up of the moving spring tip area of the clothes hanger, with single spring alterative.

FIG. 9 shows the alternative hook tip area 12H which is a short spring attached to the hook 3H via an end fitting 19, which is a 360-degree groove around the hook end into which the rim of the spring 12H seats.

The invention claimed is:

1. A clothes hanger for disabled or height restricted people comprising:

a hook vertically located into a shoulder frame which has a hook tip area with movement aided by a pivot pin and a spring mechanism;

a horizontal bar section derived of two equal sections with closure holding means, the two equal sections pivotally connected to the shoulder frame, each of the two individual sections has a return movement for returning the respective individual sections to a horizontal position aided by a respective pivot pin and a respective spring mechanism.

2. The clothes hanger for disabled or height restricted people according to claim 1, wherein the clothes hanger further comprises a spring tip hook area.

3. The clothes hanger for disabled or height restricted people according to claim 1, wherein said spring mechanism of at least one of the hook tip area or the individual sections further comprises a spring.

4. The clothes hanger for disabled or height restricted people according to claim 1, wherein said spring mechanism of at least one of the hook tip area or the individual sections further comprises a coil spring.

5. The clothes hanger for disabled or height restricted people according to claim 1, wherein said spring mechanism of at least one of the hook tip area or the individual sections further comprises spring retainers.

6. The clothes hanger for disabled or height restricted people according to claim 1, wherein said spring mechanism of the respective individual sections further comprise a fixture pin.

7. The clothes hanger for disabled or height restricted people according to claim 1, wherein said holding means for the sections of the horizontal bar section are two magnetic tips.

8. The clothes hanger for disabled or height restricted people as claimed in claim 1, wherein the hook tip area has an end fitting groove to hold it onto the hook.

9. The clothes hanger for disabled or height restricted people as claimed in claim 1, wherein the pivot pin of the hook tip area enables movement of the hook tip area.

10. The clothes hanger for disabled or height restricted people as claimed in claim 1, wherein the pivot pins of the individual sections enable movement of the respective individual sections.

11. The clothes hanger for disabled or height restricted people as claimed in claim 1, wherein the spring mechanism of the hook tip area enables the hook tip area to move and return to position.

12. The clothes hanger for disabled or height restricted people as claimed in claim 1, wherein the spring mechanism of the respective individual sections enables the two individual sections to move and return to position.

13. The clothes hanger for disabled or height restricted people according to claim 1, holds clothing which are configured to be removed more easily by disabled or height restricted persons due to the aforementioned features.

14. A clothes hanger for disabled or height restricted people comprising:

a shoulder frame having ends with a horizontal bar section connected at said ends of the shoulder frame for hanging legwear, the horizontal bar section derived of two equal sections with closure holding means, the two equal sections pivotally connected to the shoulder frame, each of the two individual sections has a return movement for returning the respective individual section to a horizontal position aided by a respective pivot pin and a respective spring mechanism;

a hook fixed centrally on the shoulder frame, the hook is flat with a separate tip area able to lift and pivot by a pivot pin fitting and a spring-biased mechanism adapted to allow the tip area to move and lift, wherein when the disabled or height restricted people removes the hanger from a rail pole, the tip area is forced against bias of the spring-biased mechanism to move upwards and pivot enabling the hook to have clearance to be removed from the pole due to downward pull on the hanger.

* * * * *